US007637121B2

(12) United States Patent
Owen et al.

(10) Patent No.: US 7,637,121 B2
(45) Date of Patent: Dec. 29, 2009

(54) NATURAL GAS LIQUEFACTION PROCESS

(75) Inventors: Ryan Oliver Owen, Houston, TX (US); Guy Richard Jones, Jr., Katy, TX (US); Jeffrey H. Sawchuk, Katy, TX (US)

(73) Assignee: BP Corporation North America Inc., Warrenville, IL (US)

( * ) Notice: Subject to any disclaimer, the term of this patent is extended or adjusted under 35 U.S.C. 154(b) by 313 days.

(21) Appl. No.: 11/196,958

(22) Filed: Aug. 4, 2005

(65) Prior Publication Data

US 2006/0112725 A1 Jun. 1, 2006

Related U.S. Application Data

(60) Provisional application No. 60/599,753, filed on Aug. 6, 2004.

(51) Int. Cl.
*F25J 1/00* (2006.01)

(52) U.S. Cl. ..... 62/611; 62/612

(58) Field of Classification Search ..... 62/611, 62/612

See application file for complete search history.

(56) References Cited

U.S. PATENT DOCUMENTS

| | | | |
|---|---|---|---|
| 3,348,384 | A | 10/1967 | Harmens |
| 3,440,828 | A | 4/1969 | Pryor et al. |
| 3,548,606 | A | 12/1970 | Kuerston |
| 3,724,226 | A | 4/1973 | Pachaly |
| 3,763,658 | A | 10/1973 | Gaumer et al. |
| 4,065,276 | A | 12/1977 | Nakaya et al. |
| 4,172,711 | A | 10/1979 | Bailey |
| 4,404,008 | A | 9/1983 | Rentier et al. |
| 4,445,916 | A | 5/1984 | Newton |
| 4,445,917 | A | 5/1984 | Chiu |
| 4,504,296 | A | 3/1985 | Newton et al. |
| 4,545,795 | A | 10/1985 | Liu et al. |
| 4,755,114 | A | 7/1988 | Shibayashi et al. |

(Continued)

FOREIGN PATENT DOCUMENTS

| | | |
|---|---|---|
| FR | 2714720 | 7/1995 |

(Continued)

OTHER PUBLICATIONS

Pruitt, "Mineral Terms—Some Problems In Their Use and Definition," Rocky Mt. Min. L. Rev. 1, 16 (1966).

(Continued)

*Primary Examiner*—William C Doerrler
(74) *Attorney, Agent, or Firm*—Albert K. Shung

(57) ABSTRACT

Disclosed is a process for liquefying natural gas wherein an available methane-rich feed, i.e., natural gas, at an excess pressure is initially expanded to provide expansion work which may be utilized in a number of novel ways, such as to provide refrigeration in a refrigerant cycle used to cool the feed or in one or more refrigerant cycles used in a liquefaction zone to liquefy the feed, or to generate electrical power for use in the liquefaction process or for export. In one embodiment, the expansion work is obtained by use of an expander/compressor device (turboexpander) which expands the feed to (1) drive the compressor of the device and thereby provide compression for a closed loop propane refrigeration cycle to precool the natural gas stream, and (2) produce an expanded, chilled natural gas feed for a liquefaction process. The production of a chilled natural gas feed to a liquefaction process can either increase the volume of LNG production for a given amount of installed horsepower, or alternatively, can be used to reduce the capital cost and/or operating cost associated with the production of a given amount of LNG.

37 Claims, 1 Drawing Sheet

U.S. PATENT DOCUMENTS

| | | | | | |
|---|---|---|---|---|---|
| 4,755,200 | A | | 7/1988 | Liu et al. | |
| 4,901,533 | A | | 2/1990 | Fan et al. | |
| 4,970,867 | A | | 11/1990 | Herron et al. | |
| 5,473,900 | A | | 12/1995 | Low | |
| 5,537,827 | A | | 7/1996 | Low et al. | |
| 5,651,269 | A | | 7/1997 | Prevost et al. | |
| 5,669,234 | A | | 9/1997 | Houser et al. | |
| 5,755,114 | A | | 5/1998 | Foglietta | |
| 5,950,453 | A | * | 9/1999 | Bowen et al. | 62/612 |
| 6,016,665 | A | * | 1/2000 | Cole et al. | 62/612 |
| 6,023,942 | A | | 2/2000 | Thomas et al. | |
| 6,041,619 | A | | 3/2000 | Fischer et al. | |
| 6,062,041 | A | | 5/2000 | Kikkawa et al. | |
| 6,119,479 | A | | 9/2000 | Roberts et al. | |
| 6,125,653 | A | | 10/2000 | Shu et al. | |
| 6,158,240 | A | | 12/2000 | Low et al. | |
| 6,248,794 | B1 | | 6/2001 | Gieskes | |
| 6,250,244 | B1 | * | 6/2001 | Dubar et al. | 114/264 |
| 6,253,574 | B1 | | 7/2001 | Stockmann et al. | |
| 6,295,833 | B1 | * | 10/2001 | Hoffart et al. | 62/613 |
| 6,694,774 | B1 | * | 2/2004 | Rashad et al. | 62/612 |
| 6,751,985 | B2 | | 6/2004 | Kimble et al. | |
| 2003/0005722 | A1 | | 1/2003 | Wilkinson et al. | |
| 2003/0226373 | A1 | * | 12/2003 | Prible et al. | 62/612 |

FOREIGN PATENT DOCUMENTS

| | | |
|---|---|---|
| GB | 2357140 | 6/2001 |
| WO | 2004057252 | 7/2004 |
| WO | 2004088232 | 10/2004 |

OTHER PUBLICATIONS

Collins et al., "Liquefaction Plant Design in the 1990s", Hydrocarbon Processing, vol. 74, No. 4, Apr. 1, 1995.

* cited by examiner

NATURAL GAS LIQUEFACTION PROCESS

RELATED APPLICATIONS

This application is entitled to and claims the benefit of U.S. Provisional Patent Application Ser. No. 60/599,753, filed Aug. 6, 2004, the teachings of which are incorporated herein by reference in their entirety.

FIELD OF THE INVENTION

The present invention is directed to a process for liquefying methane-rich gas streams, such as natural gas, and to the more efficient production of such liquefied streams.

BACKGROUND OF THE INVENTION

Natural gas generally refers to rarefied or gaseous hydrocarbons (comprised of methane and light hydrocarbons such as ethane, propane, butane, and the like) which are found in the earth. Non-combustible gases occurring in the earth, such as carbon dioxide, helium and nitrogen are generally referred to by their proper chemical names. Often, however, non-combustible gases are found in combination with combustible gases and the mixture is referred to generally as "natural gas" without any attempt to distinguish between combustible and non-combustible gases. See Pruitt, "Mineral Terms-Some Problems in Their Use and Definition," Rocky Mt. Min. L. Rev. 1, 16 (1966).

Natural gas is often plentiful in regions where it is uneconomical to develop those reserves due to lack of a local market for the gas or the high cost of processing and transporting the gas to distant markets.

It is common practice to cryogenically liquefy natural gas so as to produce a liquefied natural gas product ("LNG") for more convenient storage and transport. A fundamental reason for the liquefaction of natural gas is that liquefaction results in a volume reduction of about 1/600, thereby making it possible to store and transport the liquefied gas in containers at low or even atmospheric pressure. Liquefaction of natural gas is of even greater importance in enabling the transport of gas from a supply source to market where the source and market are separated by great distances and pipeline transport is not practical or economically feasible. In some cases the method of transport is by ocean going vessels. It is uneconomical to transport gaseous materials by ship unless the gaseous materials are highly compressed. Even then the transport would not be economical because of the necessity of providing containers of suitable strength and capacity.

In order to store and transport natural gas in the liquid state, the natural gas is typically cooled to −240° F. (−151° C.) to −260° F. (−162° C.) where it may exist as a liquid at near atmospheric pressure. Many LNG liquefaction plants utilize a mechanical refrigeration cycle for the cooling of the inlet gas stream, such as of the cascaded or mixed refrigerant types, as is generally disclosed in U.S. Pat. No. 3,548,606, the teachings of which are incorporated herein by reference. Various other methods and/or systems exist for liquefying natural gas whereby the gas is liquefied by sequentially passing the gas at an elevated pressure through a plurality of cooling stages, and cooling the gas to successively lower temperatures until liquefaction is achieved. Cooling is generally accomplished by heat exchange with one or more refrigerants such as propane, propylene, ethane, ethylene, nitrogen and methane, or mixtures thereof, in a closed loop or open loop configuration. The refrigerants can be arranged in a cascaded manner, in order of diminishing refrigerant boiling point. For example, processes for preparation of LNG generally are disclosed in U.S. Pat. Nos. 4,445,917; 5,537,827; 6,023,942; 6,041,619; 6,062,041; 6,248,794, and UK Patent Application GB 2,357,140 A. The teachings of all of the foregoing patents are incorporated herein by reference in their entirety.

Additionally, the liquefied natural gas can be expanded to atmospheric pressure by passing the liquefied gas through one or more expansion stages. During the course of the expansion, the gas is further cooled to a suitable storage or transport temperature and is pressure reduced to approximately atmospheric pressure. In this expansion to atmospheric pressure, significant volumes of natural gas may be flashed. The flashed vapors may be collected from the expansion stages and recycled or burned to generate power for the liquid natural gas manufacturing facility.

The cascaded refrigeration cycle type plants are typically relatively expensive to build and operate, and the mixed refrigerant cycle plants also can require close attention of stream compositions during operation. Refrigeration equipment is particularly expensive because of the low temperature metallurgy requirements of the components. However, liquefaction of natural gas is an increasingly important and widely-practiced technology to convert the gas to a form which can be transported and stored readily and economically. The costs and energy expended to liquefy the gas must be minimized to yield a cost-effective means of producing and transporting the gas from the gas field to the end user. Process technology which reduces the cost of liquefaction in turn reduces the cost of the gas product to the end user.

Process cycles for liquefaction of natural gas historically have utilized isentropic expansion valves, or Joule Thomson (J-T) valves, to produce refrigeration required to liquefy the gas. Typical process cycles utilizing expansion valves for this purpose are described for example in U.S. Pat. Nos. 3,763,658, 4,065,276, 4,404,008, 4,445,916, 4,445,917, and 4,504,296.

The work of expansion which is produced when process fluids flow through such valves is essentially lost. In order to recover at least a portion of the work produced by the expansion of these process fluids, expansion machines such as reciprocating expanders or turboexpanders can be utilized. For example, U.S. Pat. Nos. 4,445,916; 4,970,867; and 5,755,114 describe use of turboexpanders in connection with the production of LNG.

The term "expander" or "expander/compression device" as used herein generally is in reference to such turborexpanders or reciprocating expanders. In the field of natural gas liquefaction, the term "expander" is usually used to denote a turboexpander, and is so used in the present disclosure.

Applicants are unaware of any previous attempts to utilize the excess pressure of a methane-rich gas feed stream, such as a natural gas stream, as a source of refrigeration for a LNG process, such as to provide compression for a refrigeration cycle used to pre-cool the natural gas before it is directed to a liquefaction zone, or compression for one or more refrigeration cycles used to liquefy the natural gas in the liquefaction zone. While most liquefaction processes utilize a methane-rich feed which is typically delivered at a pressure of 650 psig (44.8 barg) to 1000 psig (69.0 barg), there are many instances where the supplied natural gas may be available at higher pressures, such as from about 1000 psig (69.0 barg) and to as high as 2500 psig (172.4 barg) or greater. This gas may be produced at such pressures from an underground geological formation; or it may be compressed to such pressure after it is produced for any number of reasons associated with the requirements of the production field; or it may be compressed due to the requirements of local pipelines or gas transmission systems adjacent to the production field. Use of such a preliminary step prior to liquefaction could result in a liquefaction plant that is less expensive to build and/or operate, and/or allow for a greater amount of LNG production for a given plant design. Alternatively, the excess pressure can be converted into mechanical work that may used to generate electrical power which could also yield a more efficient process.

As can be seen, it would be desirable to utilize the excess energy resident within such available gas streams in a manner which results in a more efficient and/or potentially less expensive LNG liquefaction process.

SUMMARY OF THE INVENTION

The foregoing objects and advantages may be attained in accordance with the invention, which in one aspect relates to a process for liquefying a pressurized natural gas stream. The process comprises the steps of:

(a) providing the pressurized natural gas stream at a first pressure and a first temperature;

(b) cooling the pressurized natural gas stream by indirect heat exchange with a cold refrigerant stream to produce a cooled pressurized natural gas stream at a second temperature colder than the first temperature;

(c) expanding the cooled pressurized natural gas stream in an expansion device, wherein expansion work from the expansion device is used to drive a compressor which compresses a refrigerant stream to produce a pressurized refrigerant stream, the expansion resulting in a chilled feed stream that is directed to a natural gas liquefaction zone;

(d) cooling the pressurized refrigerant stream to produce a cooled, at least partially condensed pressurized refrigerant stream;

(e) expanding the cooled, at least partially condensed pressurized refrigerant stream to produce the cold refrigerant stream employed in (b); and (f) liquefying the chilled feed stream in the natural gas liquefaction zone.

In embodiments, the invention is directed to a process for liquefying a pressurized natural gas stream comprising the steps of:

(a) providing the pressurized natural gas stream at a first pressure and a first temperature;

(b) cooling the pressurized natural gas stream by indirect heat exchange with a cold refrigerant stream to produce a cooled pressurized natural gas stream at a second temperature colder than the first temperature;

(c) expanding the cooled pressurized natural gas stream in an expansion device to produce a chilled feed stream, wherein expansion work from the expansion device is used to provide refrigeration to produce the cold refrigerant stream; and (d) liquefying the chilled feed stream in a liquefaction zone.

In other aspects, the invention relates to a process to prepare a chilled natural gas feed stream comprising:

(a) providing a pressurized natural gas stream at a first pressure and a first temperature;

(b) cooling the pressurized natural gas stream by indirect heat exchange with a cold refrigerant stream to produce a cooled pressurized natural gas stream at a second temperature colder than the first temperature; and (c) expanding the cooled pressurized natural gas stream in an expansion device to produce the chilled feed stream, wherein expansion work from the expansion device is used to produce the cold refrigerant stream.

In another aspect, the invention relates to a process for liquefying a pressurized natural gas stream comprising:

(a) providing the pressurized natural gas stream at a first pressure and a first temperature;

(b) expanding the pressurized natural gas stream in an expansion device to produce a chilled feed stream, wherein expansion work from the expansion device is used to provide refrigeration for production of LNG; and.

(c) liquefying the chilled feed stream in a liquefaction zone.

In another aspect, the invention is directed to a process for liquefying a pressurized natural gas stream. The process comprises the steps of:

(a) providing the pressurized natural gas stream at a first pressure and a first temperature;

(b) expanding the pressurized natural gas stream in an expansion device to produce a chilled feed stream and expansion work; and (c) liquefying the chilled feed stream in a liquefaction zone.

DETAILED DESCRIPTION OF THE INVENTION

Figure 1:
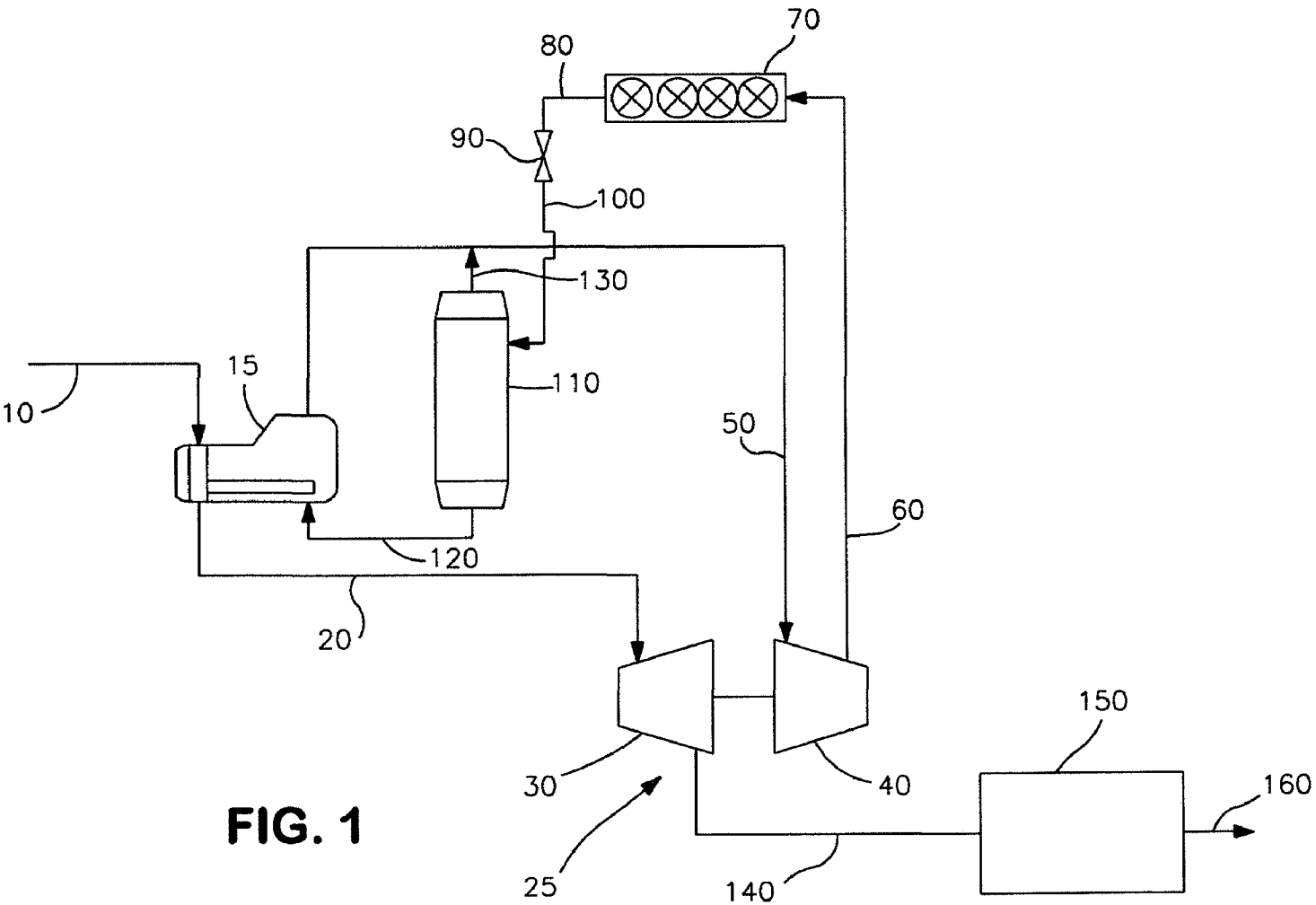
FIG. 1 is a simplified process flow diagram of an embodiment of the invention, wherein the excess pressure from a pressurized natural gas stream is expanded in an expander/compressor device to produce mechanical work that (1) drives the compressor of the device and thereby provides compression for a closed loop propane refrigeration cycle to pre-cool the natural gas stream, and (2) produces an expanded, chilled natural gas feed for a liquefaction process.

The present invention is directed to a process for producing LNG from methane-rich gas streams, such as natural gas as that term is defined above. The natural gas contemplated herein generally comprises at least 50 mole percent methane, preferably at least 75 mole percent methane, and more preferably at least 90 mole percent methane. The balance of natural gas generally comprises other combustible hydrocarbons such as, but not limited to, lesser amounts of ethane, propane, butane, pentane, and heavier hydrocarbons and non-combustible components such as carbon dioxide, hydrogen sulfide, helium and nitrogen.

The presence of heavier hydrocarbons such as ethane, propane, butane, pentane, and hydrocarbon boiling at a boiling point above propane is generally reduced in the natural gas through gas-liquid separation steps. Hydrocarbon boiling at a temperature above the boiling point of pentane or hexane is generally directed to crude oil. Hydrocarbon boiling substantially at a temperature above the boiling point of ethane and below the boiling point of pentane or hexane is generally removed and considered to be natural gas liquids or "NGLs" for purposes of the present invention. Such NGLs may be recovered from the natural gas feed stream employed in the invention either upstream or downstream of the process disclosed herein.

For most markets, it is also desirable to minimize the presence of non-combustibles and contaminants in LNG such as carbon dioxide, helium and nitrogen and hydrogen sulfide. Depending on the quality of a given natural gas reservoir (which may contain as much as 50% to 70% carbon dioxide), the natural gas may be pre-processed at a natural gas plant for pre-removal of such of the above components or may be conveyed directly to the plant for pre-processing prior to manufacture of LNG.

Natural gas is generally made available or transported at elevated pressures as high as 2800 psig (193.1 barg) or greater. According to the present invention, suitable natural gas feeds will have pressures generally higher than those typically provided to an LNG facility, such as a pressure at least about 200 psig (13.8 barg) greater than the design pressure of typical LNG liquefaction processes, which are typically designed for a feed pressure of about 650 psig (44.8 barg) to 1000 psig (69.0 barg). Desirably, the feed pressure employed in process of the present invention is about 1000 psig (69.0 barg) or more, such as from about 1300 psig (89.6 barg) to about 2500 psig (172.4 barg) or greater. The temperature of the natural gas is dependent on its originating source. Where the natural gas is pipeline gas, its temperature can approximate ambient conditions such as for example, 0° F. (−17.8° C.) to 120° F. (48.9° C.), more typically from 50° F. (10° C.) to 100° F. (37.8° C.). If the natural gas conditions are measured in proximity to a conveyance device such as a natural gas compressor, outlet and post-compression equipment may dictate or affect the temperature and pressure of the natural gas feed.

Pretreatment steps suitable for use with the present invention generally begin with steps commonly identified and known in connection with LNG production, including, but not limited to, removal of acid gases (such as $H_2S$ and $CO_2$), mercaptans, mercury and moisture from the natural gas stream. Acid gases and mercaptans are commonly removed via a sorption process employing an aqueous amine-containing solution or other types of known physical or chemical solvents. This step is generally performed upstream of the natural gas liquefaction zone. A substantial portion of the water is generally removed as a liquid through two-phase gas-liquid separation prior to or after low level cooling, followed by molecular sieve processing for removal of trace amounts of water. The water removal steps generally occur upstream of any expansion as contemplated herein. Mercury is removed through use of mercury sorbent beds. Residual amounts of water and acid gases are most commonly removed through the use of particularly selected sorbent beds such as regenerable molecular sieves. Such particularly selected sorbent beds are also generally positioned upstream of most of the natural gas liquefaction steps.

The present invention is described in reference to FIG. 1, which depicts an embodiment of the invention, wherein the excess pressure from a pressurized natural gas stream is utilized by expansion of the gas stream in an expander/compressor device to produce mechanical work which for example (1) drives the compressor of the device and thereby provides compression for a closed loop propane refrigeration cycle to pre-cool the natural gas stream, and (2) produces an expanded, chilled natural gas feed for a liquefaction process. The refrigeration cycle may also use any other refrigerant known in the art, such as a dual mixed refrigerant.

In reference to FIG. 1, a natural gas feed at relatively high pressure, such as from about 1000 psig (69.0 barg) to 2500 psig (172.4 barg), and more desirably 1300 psig (89.6 barg) to 2500 psig (172.4 barg), is introduced into the process via line 10. Such feed may be at ambient temperatures, such as about 50° F. (10° C.) to 100° F. (37.8° C.) as previously mentioned. Line 10 directs the natural gas feed to a chiller 15 wherein the feed is cooled by indirect heat exchange with a refrigerant, e.g., propane, conveyed by a closed loop system. The refrigerant may be introduced to chiller 15 in a two phase (vapor and liquid) form, but it is preferred that the amount of vapor is minimized such that the refrigerant is substantially in the liquid phase. The refrigerant is introduced into chiller 15 via line 120. In chiller 15, the refrigerant is vaporized and exits the chiller 15 via line 50. The natural gas feed is cooled in chiller 15 and exits via line 20. The cooled natural gas feed exits at essentially the same pressure as charged to the chiller 15, and at a temperature which can be from about −30° F. (−34.4° C.) to 50° F. (10° C.) if the feed is introduced to the process of the invention at the temperature and pressure ranges previously described.

The cooled natural gas feed is then conveyed by line 20 to turboexpander 25, wherein it is introduced into the expander portion 30 thereof. In expander portion 30, the natural gas feed can be expanded to adjust the pressure thereof to essentially the design pressure of the liquefaction process to be employed in production of LNG. Typically, the pressure of the natural gas is expanded to about 650 psig (44.8 barg) to 1000 psig (69.0 barg). The temperature of the chilled natural gas feed exiting the expander portion 30 via line 140 can be at relatively low temperatures that may be advantageously employed as feed to an NGL recovery unit (if desired: not shown) and/or a liquefaction zone 150, such as a temperature of −100° F. (−73.3° C.) to −60° F. (−51.1° C.). If desired, it is also possible to direct the chilled natural gas feed to process units for removal of acid gases or mercury contaminants, although it may be more advantageous to remove such contaminants prior to the pre-cooling step previously described.

Refrigerant vapor conveyed by line 50 from chiller 15 is compressed in compressor portion 40 of turboexpander 25. After compression in compressor portion 40, the pressurized refrigerant vapor is conveyed by line 60 to condenser 70. Condenser 70 may be an air-cooled heat exchanger, but any heat exchange apparatus known in the art can also be used. Condenser 70 is used to at least partially condense the refrigerant into the liquid phase, and preferably to substantially condense most, and more preferably all, of the refrigerant into the liquid phase. Further, while not shown on FIG. 1, it is preferred to employ an additional cooler downstream of condenser 70 to sub-cool the condensed, at least partially (and preferably all) liquid refrigerant stream so that after the refrigerant exits a pressure-reduction device 90, as described hereinafter, the vapor fraction of the refrigerant stream is minimized, i.e., it is preferably less than 0.5 and more preferably less than 0.35. Thereafter, the cooled refrigerant is directed through the pressure-reduction device 90, such as a Joule-Thompson valve, wherein the refrigerant is further cooled. The cooled refrigerant may thereafter be optionally directed by line 100 to separation vessel 110, which separates and recovers refrigerant in vapor form and directs the same via lines 130 and 50 back to compressor portion 40. The refrigerant is then directed from separation vessel 110 to chiller 15 via line 120. Advantageously, it is generally more convenient to simply omit line 100, separator vessel 110, and line 130, as is illustrated by the example described hereinafter, such that after being directed to the pressure-reduction device 90, the resulting refrigerant stream is sent directly to chiller 15 via line 120. In this way, substantially all of the chilled refrigerant stream, which may be two phase at this point (vapor and liquid) is used in chiller 15.

The chilled natural gas feed is directed by line 140 to liquefaction zone 150 for production of LNG and thereafter the LNG is conveyed from liquefaction zone 150 by product line 160, which liquefaction zone may comprise any liquefaction process known in the art. Examples of a cascade-type liquefaction process are disclosed in U.S. Pat. Nos. 4,172,711; 5,537,827; 5,669,234; and 6,158,240, the teachings of which are incorporated herein by reference in their entirety.

Examples of mixed refrigerant-type liquefaction processes are disclosed in U.S. Pat. No. 4,901,533 (single mixed refrigerant cycle); U.S. Pat. Nos. 4,545,795 and 6,119,479 (dual mixed refrigerant cycles); and U.S. Pat. 6,253,574 (triple mixed refrigerant cycles). The teachings of these patents are also incorporated herein by reference in their entirety.

By use of the excess pressure available in such natural gas feeds, as described above, one need only provide the refrigeration necessary to decrease the chilled feed temperature to that where liquefaction occurs, such as from about −90° F. (−67.8° C.) to −260° F. (−162.2° C.), rather than from ambient temperatures, such as 75° F. (23.9° C.) to −260° F. (−162.2° C.). As a result, increased volumes of LNG can be produced for the same amount of installed plant horsepower (refrigeration) in a conventional LNG process. This production increase can be on the order of 15% to 20% for the same installed horsepower. Alternatively, the use of such excess pressure can be used to reduce the capital cost and/or operating costs for the process by reduction of the installed horsepower necessary to produce a given quantity of LNG.

In addition, the expansion work obtained by expanding the pressurized natural gas feed stream in an expansion device, such as a turboexpander, can be utilized to provide compression for other refrigerant streams employed in the liquefaction zone, such as compression for the cascaded refrigerant streams used in a cascade-type liquefaction process as previously mentioned and incorporated herein by reference, or a mixed refrigerant type process (which may employ one or more mixed refrigerant cycles), as previously mentioned and incorporated herein by reference. The expansion work could also be used to drive an electrical generator for production of electricity, either for use in the liquefaction process or for export to a local power grid.

The present invention is further described by the following example, which should be understood as an example provided for illustration purposes only and not to limit the scope of the claims appended hereto.

SPECIFIC EMBODIMENTS OF THE INVENTION

In this example, the process and apparatus employed in the practice of the invention are used to chill a natural gas feed stream prior to recovery of NGL components therein and its further use in making LNG in a natural gas liquefaction plant, such as a cascade type or dual mixed refrigerant process, designed to produce about 5 million metric tonnes per year of LNG.

The natural gas feed employed is first treated to remove contaminants, water and acid gas components, such as $CO_2$ and sulfur-containing compounds, and after such pre-treatment it has the following composition on a mole percent basis: methane (94.12%), ethane (3.34%), propane (1.23%), i-butane (0.31%), n-butane (0.38%), i-pentane (0.20%), n-pentane (0.20%), and hexane (0.22%). The natural gas feed, at the point within line 10 of FIG. 1, has a temperature of 23.9° C. and pressure of 137.9 barg. The molar and mass flow rate of the natural gas feed in line 10 is as shown in Table I below.

The apparatus used is that as described in reference to FIG. 1 (the reference numbers for equipment and piping being retained herein for convenience), except as described otherwise hereinafter. Propane is used as the refrigerant. In the propane refrigerant loop and downstream of condenser 70, a further cooler, such as an air-cooled heat exchanger (not shown in FIG. 1), is used to sub-cool the liquid propane refrigerant after it is condensed in condenser 70, so that after the refrigerant exits Joule-Thompson valve 90, the refrigerant stream is still substantially in the liquid phase. The conditions of the propane refrigerant after being cooled in condenser 70, but prior to being sub-cooled, are indicated in Table I under the column for process stream 75 (which stream is not shown in FIG. 1) and the conditions of the refrigerant after being sub-cooled, but prior to being introduced into Joule-Thompson valve 90, are shown in Table I under the column for process stream 80. Also, the apparatus employed does not use line 100, separator 110, or line 130 as shown in FIG. 1. Rather, after being exiting Joule-Thompson valve 90, the resulting cold propane refrigerant stream (now two phase flow—vapor fraction of 0.305) is conveyed by line 120 directly to chiller 15. The conditions of the refrigerant stream exiting Joule-Thompson valve 90 are shown in Table I under the column for process stream 120.

Other process streams employed in the apparatus of this example, which otherwise correspond to those of FIG. 1, are as shown in Table I. Further, expansion of the cooled natural gas feed in expander portion 30 of turboexpander 25 results in generation of 10,430 kilowatts (kw) of mechanical power, which is used to compress the propane refrigerant in compressor portion 40 of turboexpander 25.

The resulting chilled natural gas feed in line 140 is produced at a molar flow rate of 49,807 kmole/hr and a mass flow rate of 872,832 kg/hr, which is then directed to conventional apparatus for recovery of a portion of the NGLs that condense after the expansion of the cooled natural gas stream 20 in expander portion 30 of turboexpander 25. After NGL recovery, the remaining portion of the chilled natural gas feed stream is sent to the liquefaction plant for preparation of LNG.

TABLE I

| | Stream No. | | | | | | | |
|---|---|---|---|---|---|---|---|---|
| | 10 | 20 | 50 | 60 | 75 | 80 | 120 | 140 |
| Vapor Faction | 1 | 1 | 1 | 1 | 0 | 0 | 0.305 | 0.938 |
| Temp. (° C.) | 23.9 | −11.5 | −17.0 | 49.6 | 32.2 | 29.4 | −17.0 | −56.8 |
| Pressure (barg) | 137.9 | 137.9 | 2.7 | 11.5 | 11.4 | 11.3 | 2.7 | 55.2 |
| Molar Flow Rate (kmol/hr) | 49,807 | 49,807 | 9,464 | 9,464 | 9,464 | 9,464 | 9,464 | 49,807 |
| Mass Flow Rate (kg/hr) | 872,832 | 872,832 | 417,341 | 417,341 | 417,341 | 417,341 | 417,831 | 872,832 |

All patent or other documents referenced herein are incorporated herein by reference in their entirety.

Other embodiments and benefits of the invention will be apparent to those skilled in the art from a consideration of this specification or from practice of the invention disclosed herein. It is intended that this specification be considered as exemplary only with the true scope and spirit of the invention being indicated by the following claims.

We claim:

1. A process for liquefying a pressurized natural gas stream comprising the steps of:

(a) providing a pressurized natural gas feed stream at a first pressure and a first temperature;

(b) pre-cooling the pressurized natural gas feed stream by indirect heat exchange with a cold refrigerant stream to produce a cooled pressurized natural gas feed stream at a second temperature colder than the first temperature;

(c) expanding the cooled pressurized natural gas feed stream in an expansion device, wherein expansion work from the expansion device is used to drive a compressor which compresses a refrigerant stream to produce a pressurized refrigerant stream for use in (b), the expansion resulting in a chilled feed stream that is directed to a natural gas liquefaction zone, wherein the chilled feed stream exiting the expansion device has a vapor fraction of at least 0.9;

(d) cooling the pressurized refrigerant stream to produce a cooled, at least partially condensed pressurized refrigerant stream;

(e) expanding the cooled, at least partially condensed pressurized refrigerant stream to produce the cold refrigerant stream employed in (b); and (f) liquefying the chilled feed stream in the natural gas liquefaction zone.

2. The process of claim 1 wherein the first pressure is about 1000 psig (69.0 barg) or greater.

3. The process of claim 1 wherein the first pressure is about 1300 psig (89.6 barg) or greater.

4. The process of claim 1 wherein the first pressure is from about 1300 psig (89.6 barg) to 2500 psig (172.4 barg).

5. The process of claim 2 wherein the first temperature is from about 50° F. (100° C.) to 100° F. (37.8° C.).

6. The process of claim 1 wherein the refrigerant stream comprises propane.

7. The process of claim 5 wherein the second temperature is from about −30° F. (−34.4° C.) to 50° F. (100° C.).

8. The process of claim 1 wherein the expansion device is a turboexpander.

9. The process of claim 1 wherein the chilled feed stream has a pressure of 650 psig (44.8 barg) to 1000 psig (69.0 barg).

10. The process of claim 7 wherein the chilled feed stream has a temperature of from −100° F. (−73.3° C.) to −60° F. (−51.10° C.).

11. The process of claim 1 wherein the liquefaction zone comprises a cascade-type liquefaction process.

12. The process of claim 1 wherein the liquefaction zone comprises a mixed refrigerant-type liquefaction process.

13. A process for liquefying a pressurized natural gas stream comprising the steps of:

(a) providing a pressurized natural gas feed stream at a first pressure and a first temperature;

(b) pre-cooling the pressurized natural gas feed stream by indirect heat exchange with a cold refrigerant stream to produce a cooled pressurized natural gas feed stream at a second temperature colder than the first temperature;

(c) expanding the cooled pressurized natural gas stream in an expansion device to produce a chilled feed stream, wherein the chilled feed stream exiting the expansion device has a vapor fraction of at least 0.9, wherein expansion work from the expansion device is used to provide refrigeration to produce the cold refrigerant stream in (b); and (d) liquefying the pre-chilled feed stream in a liquefaction zone.

14. The process of claim 13 wherein the first pressure is about 1000 psig (69.0 barg) or greater.

15. The process of claim 13 wherein the first pressure is about 1300 psig (89.6 barg) or greater.

16. The process of claim 13 wherein the first pressure is from about 1300 (89.6 barg) to 2500 psig (172.4 barg).

17. The process of claim 14 wherein the first temperature is from about 50° F. (10° C.) to 100° F. (37.8° C.).

18. The process of claim 13 wherein the refrigerant stream comprises propane.

19. The process of claim 17 wherein the second temperature is from about −300° F. (−34.40° C.) to 500 F.(100 C.).

20. The process of claim 13 wherein the expansion device is a turboexpander.

21. The process of claim 13 wherein the pre-chilled feed stream has a pressure of 650 psig (44.8 barg) to 1000 psig (69.0 barg).

22. The process of claim 19 wherein the pre-chilled feed stream has a temperature of from −100° F.(−73.3° C.) to −60° F. (−51.1° C.).

23. The process of claim 13 wherein the liquefaction zone comprises a cascade-type liquefaction process.

24. The process of claim 13 wherein the liquefaction zone comprises a mixed refrigerant-type liquefaction process.

25. A process for liquefying a pressurized natural gas stream comprising:

(a) providing the pressurized natural gas feed stream at a first pressure and a first temperature;

(b) pre-cooling the pressurized natural gas feed stream by expanding the pressurized natural gas stream in an expansion device to produce a chilled feed stream, wherein the chilled feed stream exiting the expansion device has a vapor fraction of at least 0.9, wherein expansion work from the expansion device is used to provide refrigeration before liquefying the chilled feed stream; and (c) liquefying the chilled feed stream in a liquefaction zone.

26. The process of claim 25 further comprising cooling the pressurized natural gas stream before said expansion step by indirect heat exchange with a cold refrigerant stream to produce a cooled pressurized natural gas stream at a second temperature colder than the first temperature.

27. The process of claim 26 wherein at least a portion of the expansion work is used to provide refrigeration to produce the cold refrigerant stream.

28. The process of claim 25 wherein at least a portion of the expansion work is used to provide refrigeration for the liquefaction zone.

29. The process of claim 25 wherein the liquefaction zone is a cascade-type process.

30. The process of claim 25 wherein the liquefaction zone is a mixed refrigerant-type process.

31. A process for liquefying a pressurized natural gas stream comprising:

(a) providing the pressurized natural gas stream at a first pressure and a first temperature;

(b) pre-cooling the pressurized natural gas feed stream by expanding the pressurized natural gas stream in an expansion device to produce a chilled feed stream and expansion work, wherein the chilled feed stream exiting the expansion device has a vapor fraction of at least 0.9, and wherein the expansion work is used to further cool the pressurized natural gas feed stream before (c); and (c) liquefying the chilled feed stream in a liquefaction zone.

32. The process of claim 31 further comprising cooling the pressurized natural gas stream before said expansion step by indirect heat exchange with a cold refrigerant stream to produce a cooled pressurized natural gas stream at a second temperature colder than the first temperature.

33. The process of claim 32 wherein at least a portion of the expansion work is used to provide refrigeration to produce the cold refrigerant stream.

34. The process of claim 31 wherein at least a portion of the expansion work is used to provide refrigeration for the liquefaction zone.

35. The process of claim 31 wherein a portion of the expansion work is used to drive a generator for production of electrical power.

36. The process of claim 31 wherein the liquefaction zone is a cascade-type process.

37. The process of claim 31 wherein the liquefaction zone is a mixed refrigerant-type process.

* * * * *